US006622779B1

(12) United States Patent
Mazurier

(10) Patent No.: US 6,622,779 B1
(45) Date of Patent: Sep. 23, 2003

(54) METHOD FOR CONTINUOUSLY CASTING FERRITIC STAINLESS STEEL STRIPS FREE OF MICROCRACKS

(75) Inventor: Frédéric Mazurier, Bethune (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/959,118

(22) PCT Filed: Mar. 20, 2000

(86) PCT No.: PCT/FR00/00781

§ 371 (c)(1),
(2), (4) Date: Jan. 14, 2002

(87) PCT Pub. No.: WO00/64613

PCT Pub. Date: Nov. 2, 2000

(30) Foreign Application Priority Data

Apr. 22, 1999 (FR) ..... 99 05053

(51) Int. Cl.[7] ..... B22D 11/06
(52) U.S. Cl. ..... 164/480; 164/428
(58) Field of Search ..... 164/428, 480

(56) References Cited

U.S. PATENT DOCUMENTS 5,807,444 A * 9/1998 Paradis et al. ..... 148/542
5,983,980 A * 11/1999 Freeman et al. ..... 164/480

FOREIGN PATENT DOCUMENTS

EP 0 796 685 9/1997

OTHER PUBLICATIONS

Patent Abstracts of Japan, vol. 1996, No. 10, Oct. 31, 1996 & JP 08 150442 (Sumitomo Metal Ind. Ltd.) Jun. 11, 1996.
Patent Abstracts of Japan, vol. 1997, No. 01, Jan. 31, 1997 & JP 08 225852 (Nippon Steel Corp), Sep. 3, 1996.
Patent Abstracts of Japan, vol. 197, No. 03, Mar. 31, 1997 & JP 08 295943 (Nippon Steel Corp.) Nov. 12, 1996.

* cited by examiner

*Primary Examiner*—Kuang Y. Lin
(74) *Attorney, Agent, or Firm*—Sughrue Mion, PLLC

(57) ABSTRACT

The invention concerns a method for continuously casting a ferritic stainless steep strip with thickness not more than 10 mm directly from liquid metal between two cooled rolls with horizontal axes and driven in rotation, characterized in that: the liquid metal composition in weight percentages is as follows: % C+% N≦0.12; % Mn≦1; % P≦0.4; % Si≦1; % Mo≦2.5; % Cr between 11 and 19; A1≦1%; % Ti+%Nb+% Zr≦1; the rest being iron and the impurities resulting from preparation; the $Y_p$ index of the liquid metal ranges between 35% and 60%, $Y_p$ being defined by the formula: $\gamma_p$=420% C+470% N+23% Ni+9% Cu+7% Mn 11.5% Cr 11.5% Si 12% Mo 23% V 47% Nb 49% Ti 52% A1+189: the surface roughness of said rolls being more than 5 $\mu$m; in the proximity of the meniscus metal liquid present between the rolls an inerting gas is used consisting of at least 60% by volume of a gas soluble in steel.

4 Claims, No Drawings

METHOD FOR CONTINUOUSLY CASTING FERRITIC STAINLESS STEEL STRIPS FREE OF MICROCRACKS

BACKGROUND OF THE INVENTION

The invention relates to the continuous casting of metals, and more specifically to the continuous casting, directly from liquid metal, of ferritic-type stainless steel strip whose thickness is of the order of a few mm, using the process called "twin-roll casting".

In recent years considerable progress has been made in the development of processes for casting thin carbon steel or stainless steel strip directly from liquid metal. The process mainly used at the present time is that of casting said liquid metal between two internally cooled rolls, rotating about their horizontal axes in opposite directions and placed opposite one another, the minimum distance between their surfaces being approximately equal to the thickness that it is desired to give the cast strip (for example, a few mm). The casting space containing the liquid steel is defined by the lateral surfaces of the rolls, on which the strip starts to solidify, and by lateral closure plates made of refractory which are applied against the ends of the rolls. The liquid metal starts to solidify on contact with the external surfaces of the rolls, on which solidified "shells" form, arrangements being made for the shells to join together in the "nip", that is to say the region where the distance between the rolls is a minimum.

One of the main problems encountered when manufacturing thin ferritic stainless steel strip by twin-roll casting is that there is a high risk of surface defects called microcracks appearing on the strip. These cracks are small, but they are nevertheless sufficient to make the resulting cold-treated products unsuitable for use. The microcracks form during solidification of the steel and have a depth of about 40 $\mu$m and an opening of approximately 20 $\mu$m. Their occurrence depends on the conditions, during solidification, under which the steel is in contact with the surface of the rolls over the length of their contact arc. These conditions may be described as having two successive steps. The first step relates to the initial contact between the liquid steel and the surface of the roll, which results in the formation of a solid steel shell at the surface of the rolls. The second step relates to the growth of this shell as far as the nip, where, as mentioned, it joins the shell formed on the other roll in order to constitute the fully solidified strip. The contact between the steel and the surface of the roll is determined by the topography of the surface of the casting rolls, together with the nature of the insert gas and the chemical composition of the steel. All these parameters are involved in establishing heat transfer between the steel and the roll and govern the conditions under which the shells solidify.

Various attempts have been made to develop twin-roll casting processes for obtaining, reliably, strip free of unacceptable surface defects such as microcracks.

The solutions suggested in the case of carbon steel rely on the need for good control of the heat exchange between the steel and the surface of the rolls. In particular, attempts have been made to increase the heat flux extracted from the steel, once it has started to solidify, by the casting rolls. For this purpose, the document EP-A-0 732 163 proposes the use of rolls with a very slight roughness (Ra of less than 5 $\mu$m), using these in combination with a steel composition and with production conditions which favor the formation, within the metal, of liquid oxides which wet the steel surface/roll interfaces. With regard to austenitic stainless steel, the document EP-A-0 796 685 teaches the casting of a steel whose Cr*eq*/Ni*eq* ratio is greater than 1.55 so as to minimize the phase changes at high temperature and to carry out this casting by using rolls whose surface includes touching dimples 100–500 $\mu$m in diameter and 20–50 $\mu$m in depth and by inerting the casting space with a gas soluble in the steel, or a gas mixture composed predominantly of such a soluble gas.

SUMMARY OF THE INVENTION

For ferritic stainless steel, the document JP-A-5337612 proposes the casting of a steel having a low carbon content (less than 0.05%) and a low nitrogen content (less than 0.05%) and containing niobium (0.1 to 5%) and titanium. It is also necessary, as the strip leaves the rolls, for it to be cooled at a high rate and then the temperature at which the strip is coiled must be controlled. These production and casting conditions are expensive and demanding, and the particular characteristics of the grades required limit the fields of application of the products thus obtained.

It is an object of the invention to provide a process for casting thin ferritic stainless steel strip whose surface is free of microcracks. Such a process would not require particularly demanding casting conditions to implement it and could be applied to a wide range of grades of such steels.

For this purpose, the subject of the invention is a process for the continuous casting of ferritic stainless steel strip having a thickness of less than or equal to 10 mm directly from liquid metal between two cooled rotating rolls with their axes horizontal, characterized in that:

- the liquid metal has the composition in percentages by weight: C %+N %≦0.12, Mn %≦1, P %≦0.04, Si %≦1, Mo %<2.5, Cr % between 11 and 19, Al≦1% and Ti %+Nb %+Zr %≦1, the balance being iron and impurities resulting from the smelting;
- the $\gamma_p$ index of the liquid metal is between 35% and 60%, $\gamma_p$ being defined by the formula:

$$\gamma_p = 420\ C\ \% + 470\ N\ \% + 23\ Ni\ \% + 9\ Cu\ \% + 7\ Mn\ \% - 11.5\ Cr\ \% - 11.5\ Si\ \% - 12\ Mo\ \% - 23\ V\ \% - 47\ Nb\ \% - 49\ Ti\ \% - 52\ Al\ \% + 189;$$

- the roughness Ra of the surfaces of said rolls is greater than 5 $\mu$m;
- an inert gas composed of at least 60% by volume of a gas soluble in the steel is used near the meniscus of the liquid metal present between the rolls.

As will have been understood, the invention consists in combining conditions on the composition of the metal, which govern the possibility of forming austenite at high temperature after the metal has solidified, a condition on the minimum roughness of the casting surfaces, and a condition on the composition of the inert gas. By complying with this combination, it is possible to prevent the formation of microcracks on the surface of the strip without correspondingly having to impose too demanding limitations on the casting process and without excessively restricting the fields of application of the products which will be manufactured from the cast strip.

DETAILED DESCRIPTION OF THE INVENTION

The invention will be more fully understood on reading the detailed description which follows.

One of the essential parameters in successfully casting thin strip between rolls is the control of the heat exchange between the solidifying strip and the rolls. Proper control of this transfer requires that the conditions under which the solidified shells adhere to the walls of the rolls be known and reproducible. However, when casting strip made of ferritic stainless steel containing 11 to 19% chromium, after the shell has completely solidified against the roll, the following phenomenon occurs. The solidified shell has firstly an entirely ferritic structure (δ phase) and then, as it cools, while still adhering to the surface of the roll, it undergoes a δ-ferrite/γ-austenite phase transformation in the temperature range from 1300–1400° C. This phase transformation causes local contractions of the metal, resulting in differences in density between these two phases which are appreciable at the microscopic level. These contractions may be sufficiently great to result in local loss of contact between the solidified shell and the surface of the roll. As will be understood, such loss of contact radically modifies the local heat transfer conditions. In conjunction with the surface finish of the rolls and the nature of the inert gas present in the depressions in said surface, the extent of this phase transformation, which depends on the composition of the metal, therefore influences the intensity of the heat transfer.

The extent of the δ→γ phase transformation in ferritic stainless steel may be described by the $\gamma_p$ index. This represents the maximum amount of austenite present in the metal at high temperature. This $\gamma_p$ index is calculated, in a known manner, from the composition of the metal using the so-called "Tricot and Castro" relationship (the percentages are percentages by weight):

$$\gamma_p = 420\ C\ \% + 470\ N\ \% + 23\ Ni\ \% + 9\ Cu\ \% + 7\ Mn\ \% - 11.5\ Cr\ \% - 11.5\ Si\ \% - 12\ Mo\ \% - 23\ V\ \% - 47\ Nb\ \% - 49\ Ti\ \% - 52\ Al\ \% + 189.$$

During the studies which led to the invention, it was apparent that the value of $\gamma_p$ was a good indicator of the degree of heat flux extracted by the casting rolls during solidification, all other things being equal. The heat flux extracted from the metal by the rolls may be experimentally quantified by a mean value, calculated from a measurement of the heat-up of the fluid for cooling the rolls. Experience shows that the mean heat flux extracted from the metal by the rolls is lower the higher the value of the $\gamma_p$ index.

A necessary condition for preventing cracks appearing on thin ferritic stainless steel strip cast between rolls is that, during the initial contact between the liquid metal and the rolls, the extracted heat flux be high. For this purpose, it is preferable for the inert gas surrounding the surface of the liquid metal in the region of the meniscus (the name given to the intersection between the surface of the liquid metal and the surface of the rolls) to contain a gas soluble in the steel or to consist entirely of such a gas. For this purpose, it is conventional to use nitrogen, but the use of hydrogen, ammonia, or $CO_2$ would also be conceivable. As insoluble gas possibly making the inert atmosphere up to 100%, it is conventional to use argon, but the use of another insoluble gas, such as helium, would also be conceivable. With a gas predominantly soluble in the steel, better contact between the steel and the rolls is obtained since an insoluble gas has a greater moderating effect than a soluble gas on the penetration of the metal into the depressions in the surface of the roll. Likewise, a slight roughness of the surface of the rolls provides a high heat flux as it results in a close contact between the roll and the metal.

However, after solidification has started, a very high mean heat flux increases the risk of variations between the local values of this flux. In fact, it is these heterogeneities which are the cause of surface cracks on the strip, since they generate tensile forces between the various regions of the surface, which is still weak. There would therefore be, if possible, a compromise to be found between the various requirements to be met with regard to the casting conditions if it is desired to prevent the formation of microcracks throughout the steps of solidification and of cooling of the shells against the rolls.

For this purpose, various conditions for casting ferritic stainless steel strip from liquid metal were experimented with. The experiments were carried out by casting strip with thicknesses of between 2.9 to 3.4 mm between rolls whose external surfaces, cooled by internal circulation of water, were made of copper and coated with nickel. Table 1 below shows the compositions of the metal cast during the various trials (denoted A to F) and the corresponding values of the $\gamma_p$ index and Table 2 shows the results obtained during the various trials, in terms of the surface quality obtained, according to the composition of the steel, the composition of the inert gas and the roughness of the rolls. The latter parameter is represented by the average roughness Ra, defined accordihg to the ISO 4287 (1997) Standard by the arithmetic mean of the variations in the roughness profile along the mean line within the measurement travel $l_m$. The mean line is defined as being the line, produced by filtering, which cuts the measured profile in such a way that the areas which are above the line are equal to those which are below it. According to this definition:

$$Ra = \frac{1}{lm}\int_{x=0}^{x=lm} |y|\,dx$$

TABLE 1

Compositions of the steels cast in the trials

| | C % | Mn % | P % | S % | Si % | Ni % | Cr % | Cu % | Mo % | Nb % | V % | Ti % | N % | Al % | $\gamma_p$ % |
|---|---|---|---|---|---|---|---|---|---|---|---|---|---|---|---|
| A | 0.046 | 0.415 | 0.028 | 0.0012 | 0.191 | 0.319 | 16.08 | 0.083 | 0.119 | 0.006 | 0.062 | 0.005 | 0.050 | 0.005 | 52.1 |
| B | 0.043 | 0.420 | 0.027 | 0.0023 | 0.214 | 0.335 | 16.30 | 0.091 | 0.023 | 0.002 | 0.076 | 0.002 | 0.041 | 0.003 | 45 7 |
| C | 0.038 | 0.320 | 0.023 | 0.008 | 0.448 | 0.142 | 16.67 | 0.059 | 0.152 | 0.003 | 0.074 | 0.007 | 0.042 | 0.008 | 29.5 |
| D | 0.051 | 0.392 | 0.029 | 0.0012 | 0.210 | 0.550 | 16.02 | 0.090 | 0.150 | 0.007 | 0.053 | 0.005 | 0.055 | 0.004 | 62.0 |
| E | 0.041 | 0.404 | 0.024 | 0.004 | 0.247 | 0.540 | 16.34 | 0.037 | 0.052 | 0.005 | 0.063 | 0.006 | 0.030 | 0.004 | 42.3 |
| F | 0.012 | 0.290 | 0.015 | 0.0013 | 0.560 | 0.090 | 11.50 | 0.022 | 0.001 | 0.002 | 0.079 | 0.178 | 0.010 | 0.005 | 53.4 |

TABLE 2

Influence of the casting parameters on the presence of microcracks

| Steel | $\gamma_p$ (%) | $N_2$ % in the inerting gas | Ra (μm) | Surface quality |
|---|---|---|---|---|
| A | 52.1 | 20 | 7 | microcracks |
| A | | 50 | | microcracks |
| A | | 60 | | no microcracks |
| A | | 95 | | no microcracks |
| B | 45.7 | 20 | 11 | microcracks |
| B | | 50 | | microcracks |
| B | | 60 | | no microcracks |

TABLE 2-continued

| Influence of the casting parameters on the presence of microcracks | | | | |
|---|---|---|---|---|
| Steel | $\gamma_p$ (%) | $N_2$ % in the inerting gas | Ra ($\mu$m) | Surface quality |
| B | | 95 | | no microcracks |
| C | 29.5 | 20 | 8.5 | microcracks |
| C | | 60 | | microcracks |
| C | | 95 | | microcracks |
| D | 62.0 | 90 | 7.5 | microcracks |
| E | 42.3 | 90 | 4 | microcracks |
| F | 53.4 | 60 | 7 | no microcracks |

For steels A, B and F, there are no microcracks when the nitrogen content of the inerting gas (which is a nitrogen/argon mixture) is less than 60%. All these steels have a $\gamma_p$ index of 45.7 to 53.4% and were cast with rolls having an Ra of 7 or 11 $\mu$m.

The experiment carried out on steel C shows that, even with an Ra of 8.5 $\mu$m and an inerting gas rich in nitrogen, microcracks are systematically obtained when a steel whose $\gamma_p$ index is low (29.5%) is cast. However, the experiment carried out on steel D, whose $\gamma_p$ index is 62.0%, shows that microcracks are also obtained when the cast steel has a very high $\gamma_p$ index.

The experiment carried out on steel E shows that even when the steel composition and inerting conditions are appropriate with regard to the previous trials, a low roll roughness (Ra of 4 $\mu$m) results in the formation of microcracks.

These various results may be explained in the following way.

To obtain a crack-free strip, it is necessary in the first place for the heat flux extracted during the first contact between the metal and the roll to be high. If the inerting gas is not sufficiently soluble in the steel, the mean heat flux extracted is too low and the steel does not solidify uniformly enough, thereby promoting the formation of microcracks. From this standpoint, it would also be-desirable a priori to have a low roll roughness. However, if the roughness Ra is too low, the number and the total surface area of the solidification initiation sites become very high, thereby resulting in excessively abrupt cooling which causes microcracks to appear. In addition, account must also be taken of the conditions required by the following steps in the shell solidification and cooling process. Experiments have shown that by combining a soluble gas content of at least 60% in the inerting gas with a roll roughness Ra of greater than 5 $\mu$m, satisfactory results are obtained.

During the rest of the process, as the shells solidify and cool against the rolls, it is necessary, as was mentioned, to avoid having too high an extracted flux so as to prevent thermal heterogeneities which are also sources of microcracks. From this standpoint, the minimum roughness Ra of 5 $\mu$m is justified in that the roughness peaks serve as sites for initiation and development of the solidification, and the parts in the valleys, into which the metal penetrates without necessarily reaching the bottom of the valleys, act as contraction points, absorbing the variations in volume of the skin as it solidifies and cools. However, it is not advisable to have a roughness Ra of greater than 20 $\mu$m, as otherwise the roughness which is imprinted "as a negative" on the surface of the strip is high, and this will be difficult to reduce during the subsequent cold rolling and conversion steps. There would therefore be a risk of again having a final product whose surface appearance would be unsatisfactory. The desired roughness of the rolls may be obtained by any means known for this purpose, such as by shot blasting, laser machining, a photoetching operation, an electrical discharge machining operation, etc.

The high value of the $\gamma_p$ index imposed by the composition of the metal amplifies the $\delta \rightarrow \gamma$ transformation over the entire contact arc. The solidified shells are therefore subject, over said contact arc, to separations which moderate the extracted heat flux and keep it at a suitable level, without correspondingly generating microcracks which would be due to the weakness of the shell, when the latter has already solidified sufficiently. Experiments have shown that the lower limit to be set for the $\gamma_p$ index is 35%. Above a $\gamma_p$ index of 60%, the separations caused by the $\delta \rightarrow \gamma$ transformation become too great and result in the formation of microcracks by excessive weakening of the shells.

The invention therefore provides a compromise between sometimes contradictory requirements dictated by the need to prevent the presence of surface microcracks, which form by many different mechanisms, on the cast strip. It makes it possible to dispense with the need for expensive alloying elements (stabilizing elements, such as aluminum, titanium, zirconium and niobium may optionally be present). Likewise, it does not require special conditions on the cooling and coiling of the strip after it has left the rolls.

What is claimed is:

1. A process for the continuous casting of ferritic stainless steel strip having a thickness of less than or equal to 10 mm directly from liquid metal between two cooled rotating rolls with their axes horizontal, characterized the steps of:

choosing the liquid metal to have a composition in percentages by weight: C %+N %≦0.12, Mn %≦1 P %≦0.04,Si %≦1 Mo %≦2.5, Cr % between 11 and 19, Al≦1% and Ti %+Nb %+Zr %≦1, the balance being iron and impurities resulting from the smelting;

choosing the $\gamma_p$ index of the liquid metal to be between 35% and 60%, $\gamma_p$ being defined by the formula:

$$\gamma_p = 420\ C\ \% + 470\ N\ \% + 23\ Ni\ \% + 9\ Cu\ \% + 7\ Mn\ \% - 11.5\ Cr\ \% - 11.5\ Si\ \% - 12\ Mo\ \% - 23\ V\ \%\ 47\ Nb\ \% - 49\ Ti\ \% - 52\ Al\ \% + 189;$$

choosing the roughness Ra of the surfaces of said rolls to be greater than 5 $\mu$m; and using an inert gas, composed of at least 60% by volume of a gas soluble in the steel, near the meniscus of the liquid metal present between the rolls.

2. The process as claimed in claim 1, further characterized by the step of choosing the inert gas to be a mixture of nitrogen a respective proportions of 60–100% and 0–30%.

3. The process as claimed in claim 1, further characterized by the step of choosing the surface roughness Ra of the rolls to be between 5 and 20 $\mu$m.

4. The process as claimed in claim 2, further characterized by the step of choosing the surface roughness Ra of the rolls to be between 5 and 20 $\mu$m.

* * * * *

UNITED STATES PATENT AND TRADEMARK OFFICE

CERTIFICATE OF CORRECTION

PATENT NO. : 6,622,779 B1
DATED : September 23, 2003
INVENTOR(S) : Frederic Mazurier It is certified that error appears in the above-identified patent and that said Letters Patent is hereby corrected as shown below:

Title page,
Item should read:
-- [22] PCT Filed: March 29, 2000 --

Signed and Sealed this

Twentieth Day of January, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,622,779 B1
DATED : September 23, 2003
INVENTOR(S) : Frederic Mazurier It is certified that error appears in the above-identified patent and that said Letters Patent is hereby corrected as shown below:

Column 5,
Line 17, delete “less than”, and insert -- at lest --.

Column 6,
Line 56, after “nitrogen”, delete “a”, and insert -- and argon in --;
Line 56, delete “0-30%”, and insert -- 0-40% --.

Signed and Sealed this

Fourth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,622,779 B1
DATED : September 23, 2003
INVENTOR(S) : Frederic Mazurier It is certified that error appears in the above-identified patent and that said Letters Patent is hereby corrected as shown below:

Column 5,
Line 17, delete "less than", and insert -- at least --.

Column 6,
Line 56, after "nitrogen", delete "a", and insert -- and argon in --;
Line 56, delete "0-30%", and insert -- 0-40% --.

This certificate supersedes Certificate of Correction issued January 4, 2005.

Signed and Sealed this

Tenth Day of May, 2005

JON W. DUDAS
*Director of the United States Patent and Trademark Office*